United States Patent [19]

Kuepper et al.

[11] Patent Number: 4,909,451

[45] Date of Patent: Mar. 20, 1990

[54] METHOD AND APPARATUS FOR PRODUCING AN END WINDING ON A YARN BOBBIN

[75] Inventors: Wilhelm Kuepper, Wegberg; Heinz-Lorenz Topuett, Moenchen-Gladbach; Helmuth Hensen, Moenchen-Gladbach; Uwe Fabelje, Monchen-Gladbach, all of Fed. Rep. of Germany

[73] Assignee: W. Schlafhorst & Co., Fed. Rep. of Germany

[21] Appl. No.: 327,814

[22] Filed: Mar. 22, 1989

[30] Foreign Application Priority Data

Mar. 22, 1988 [DE] Fed. Rep. of Germany ..... 3809564

[51] Int. Cl.[4] ..... B65H 65/00; D01H 1/38

[52] U.S. Cl. ..... 242/18 EW; 57/299; 242/35.6 E

[58] Field of Search ..... 57/299, 303; 242/18 R, 242/18 EW, 18 PW, 35.6 R, 35.6 E

[56] References Cited

U.S. PATENT DOCUMENTS

| | | | |
|---|---|---|---|
| 2,921,752 | 1/1960 | Bourassa et al. . | |
| 3,110,450 | 11/1963 | Raasch | 242/18 EW |
| 3,117,738 | 1/1964 | Raasch et al. | 242/18 EW |
| 3,841,074 | 10/1974 | Wachendorf et al. | 57/299 X |
| 4,617,791 | 10/1986 | Lousberg | 57/299 |
| 4,619,416 | 10/1986 | Matsui et al. | 242/35.6 E X |

FOREIGN PATENT DOCUMENTS

| | | |
|---|---|---|
| 1760243 | 12/1971 | Fed. Rep. of Germany . |
| 2305260 | 8/1974 | Fed. Rep. of Germany . |
| 361748 | 6/1962 | Switzerland . |

*Primary Examiner*—John Petrakes

*Attorney, Agent, or Firm*—Shefte, Pinckney & Sawyer

[57] ABSTRACT

A method and apparatus for producing an end winding on a bobbin on which yarn has been wound. The bobbin is wound in an unwinding direction while the trailing yarn end is engaged and a length of yarn is unwound from the bobbin by suction. The yarn is released from the suction once a length of yarn has been unwound from the bobbin, the released unwound yarn falls onto a yarn support member to be supported at a location at substantially the level of the upper end of the bobbin. The bobbin is then further rotated in the unwinding direction to wind the unwound yarn length into an end winding on the upper end of the bobbin. The yarn support member includes a pair of oppositely sloping transverse surfaces spaced lengthwise of the yarn from one another to define a receiving slot therebetween and a yarn guiding eye is disposed beneath and in communication with the receiving slot for supporting the unwound yarn length during winding of the end winding.

14 Claims, 1 Drawing Sheet

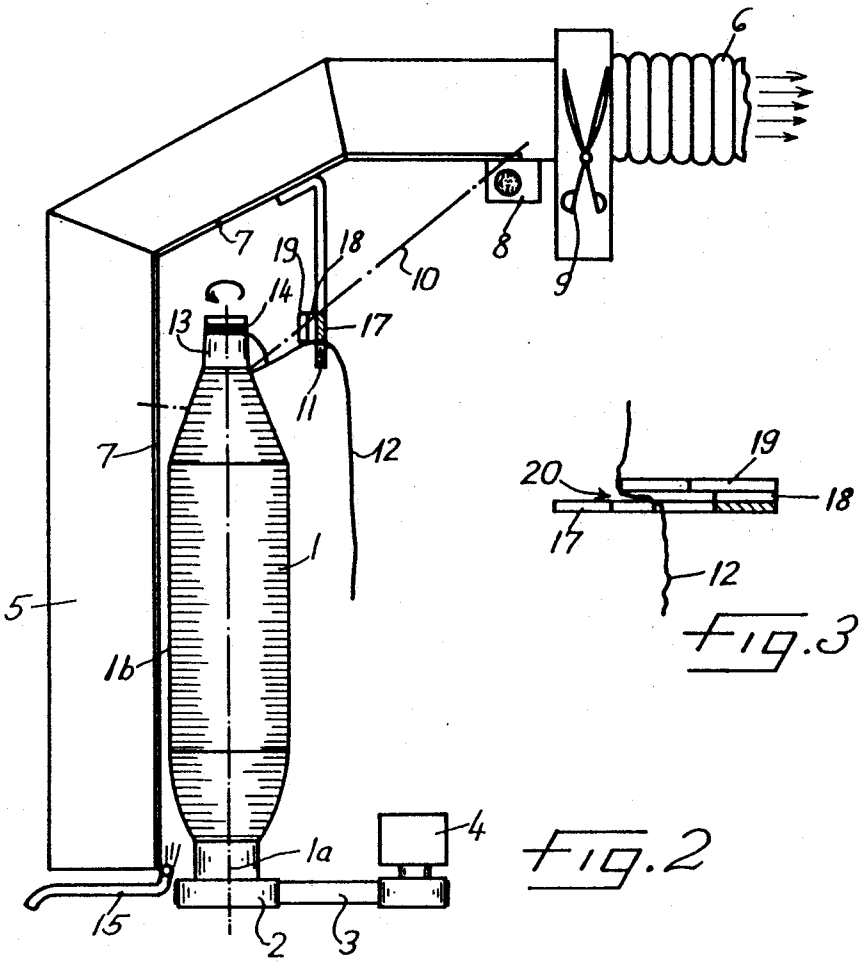
Fig. 2
Fig. 3
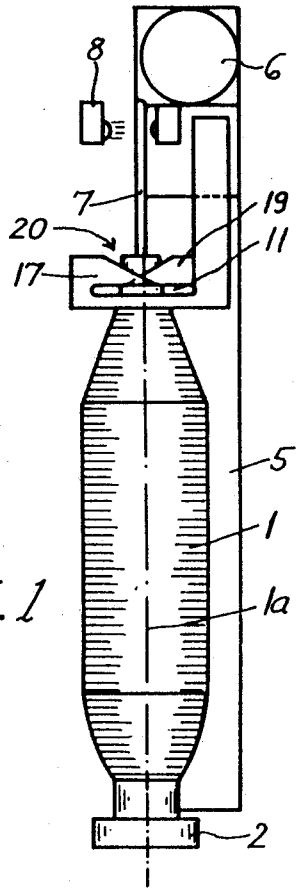
Fig. 1

METHOD AND APPARATUS FOR PRODUCING AN END WINDING ON A YARN BOBBIN

BACKGROUND OF THE INVENTION

The present invention relates to textile winding and more particularly to a method and apparatus for producing an end winding on a bobbin formed from yarn previously wound on the bobbin.

Several methods are known for preparing end windings on bobbins using the end of yarn previously wound on the bobbin during a spinning process, e.g. in ring spinning, to facilitate subsequent engagement for unwinding the yarn from the bobbin in producing cross wound packages. Such methods include the steps of rotating the bobbin in an unwinding direction to effect unwinding of the trailing end portion of the yarn and reversing the bobbin rotation to rotate the bobbin in the winding direction to wind the unwound length of yarn onto the bobbin to form the end winding. Since the bobbin is first rotated in an unwinding direction and then reversed for rotating in the winding direction, the rotation must be braked to a standstill and then reversed. This braking and reversal involves time and expense in processing and in necessary equipment.

SUMMARY OF THE INVENTION

By the present invention a method and apparatus is provided that reduces the time and expense required to form an end winding on a bobbin.

Briefly described, the present invention provides a method for forming an end winding on an upper end portion of a bobbin on which yarn has been wound including rotating the bobbin in an unwinding direction, applying a releasable yarn pulling force to the trailing end of the yarn on the bobbin to effect unwinding of a length of yarn during rotation of the bobbin in the unwinding direction, whereby the length of yarn continuously increases as the bobbin rotates, releasing the length of yarn from the yarn pulling force, supporting the unwound length of yarn at a location at substantially the level of the upper end of the bobbin and further rotating the bobbin in the unwinding direction to wind the unwound yarn length onto the upper end of the bobbin while the unwound yarn length is being supported. Preferably, the unwound yarn length is released from the application of the releasable yarn pulling force prior to supporting the unwound yarn length at the location. The supporting of the unwound yarn length is performed by a supporting member and the step of releasing the unwound yarn length includes releasing the unwound yarn length to fall onto the supporting member. In one embodiment, the releasable yarn pulling force is a suction force.

The present invention also provides an apparatus for forming an end winding on an upper end portion of a bobbin on which yarn has been wound including means for rotating the bobbin in an unwinding direction, means for applying a releasable yarn pulling force to the trailing end of the yarn on the bobbin to effect unwinding of a length of yarn during rotation of the bobbin in the unwinding direction by the rotating means, whereby the yarn length continuously increases as the bobbin rotates, means for releasing the length of yarn from the yarn pulling force, and means for supporting the unwound yarn length at a location at substantially the level of the upper end of the bobbin. The rotating means is operable to rotate the bobbin in the unwinding direction to wind the unwound yarn length onto the upper end of the bobbin while the unwound yarn length is being supported at the location. In one embodiment, the means for applying a releasable yarn pulling force and the releasing means are cooperatively arranged with respect to the supporting means such that the unwound yarn length falls onto the supporting means to be supported at a location at substantially the level of the upper end of the bobbin. The means for applying a releasable yarn pulling force includes means for applying a suction force. In one embodiment, the means for supporting the unwound yarn length includes a yarn guiding eye having a receiving slot.

In one embodiment, the present invention includes, in a textile machine of the type having a bobbin rotating device for rotating a bobbin with yarn wound thereon, a suction device for engaging a trailing end of the yarn wound on the bobbin and applying a releasable yarn pulling force thereto to effect unwinding of a yarn length during rotation of the bobbin in an unwinding direction and a device for releasing the unwound yarn length from the releasable yarn pulling force when an extent thereof has been unwound from the bobbin, the unwound yarn length providing a suitable length of yarn for winding onto the upper end of the bobbin as an end winding, a yarn support member. The yarn support member is positionable between the releasing device and the bobbin at a position relative to the unreleased unwound yarn length such that the unwound yarn length falls onto the yarn support member after it is released by the releasing device. The yarn support member is disposed relative to the bobbin for supporting the unwound yarn length at a location at substantially the level of the upper end of the bobbin during rotation of the bobbin in the unwinding direction, whereby the unwound yarn length is wound on the upper end of the bobbin while being supported by the yarn support member during the rotation of the bobbin in the unwinding direction. In one embodiment, the releasing device is controlled by a yarn monitor which monitors the unwound yarn length. The yarn support member includes a yarn guiding eye, a receiving slot for receiving the unwound yarn length as it falls and a first downwardly sloping surface for urging the unwound yarn length through the receiving slot and into the yarn guiding eye. Additionally, the yarn support member includes a second downwardly sloping surface, the first and second downwardly sloping surfaces being cooperatively arranged with respect to one another to define the receiving slot therebetween and the surfaces declining toward one another, whereby the unwound yarn length is cooperatively urged by the sloping surfaces downwardly into the receiving slot.

BRIEF DESCRIPTION OF THE DRAWINGS

FIG. 1 is a side elevation of one embodiment of the apparatus for producing an end winding on a yarn bobbin of the present invention;

FIG. 2 is a front elevation of the apparatus of FIG. 1; and

FIG. 3 is a top plan view of the yarn support member of the apparatus of FIGS. 1 and 2.

DETAILED DESCRIPTION OF THE PREFERRED EMBODIMENT

The drawings illustrate one preferred embodiment of the yarn support apparatus of the present invention. A bobbin 1 with yarn wound thereon is supported on a post of a rotating pulley 2 for rotational driving thereof about a bobbin axis 1*a*. A drive belt 3 trained around the rotating pulley 2 and around an output pulley of a drive motor 4 interconnects the rotating pulley 2 with the motor 4 for driving rotation of the rotating pulley 2. The rotation of the motor 4 is reversible to reverse the rotation of the rotating pulley 2 and, thus, the rotation of the bobbin 1 supported thereon.

A suction device 5, in the form of a tube, is positionable relative to the periphery 1*b* of the yarn wound on the bobbin 1 for engaging a trailing end of the yarn and applying a releasable yarn pulling force, in the form of suction, to effect unwinding of a length of yarn from the bobbin 1 during rotation of the bobbin 1 by the rotating pulley 2 in an unwinding direction. The suction device 5 includes a suction slot 7 configured to extend along the yarn periphery 1*b* in a direction generally parallel to the bobbin axis 1*a* and along an extent extending transversely with respect to the bobbin axis 1*a* over the top of the bobbin 1. A hose 6 connected to the suction device 5 communicates the suction device with conventional means for producing a suction force (not shown). A yarn monitor 8 is mounted to the suction device 5 and is coupled to a conventional suction blocking device and a yarn cutting device 9 located relative to the suction device 5 for blocking the suction force applied to the suction device 5 through the hose 6 and cutting the yarn end to thereby release the cut yarn end 10 which has been unwound from the bobbin 1 and pulled into the hose 6 from the action of the suction force applied thereto. The yarn monitor 8 senses the presence of the unwound yarn length 10 and activates the blocking device and cutting device 9 in response to sensing, to release the cut unwound yarn length 10 from the suction action. The yarn length 10 is thus allowed to fall under its own weight onto the yarn support member of the preset invention to be supported in its released state (designated as 12 in FIGS. 1 and 3). The cut unwound yarn length 12 is thus ready for winding onto the upper end 13 of the bobbin 1 as an end winding 14.

An air conduit 15 connected to an air blowing source (not shown) is of conventional construction and is connected to the yarn monitor 8 to be controlled thereby. The air conduit 15 is controlled to blow a stream of air on the bobbin 1 in conjunction with the operation of the suction device 5 to facilitate engagement of the trailing yarn end by the suction device 5. Additionally, the air conduit 15 can be controlled by the yarn monitor 8 to stop the air flow during the operation of the cutting device 9 or, alternatively, to control the magnitude of the air blown from the air conduit 15, including controlling the air to be delivered in intermittent bursts.

The yarn support member of the apparatus of the present invention includes a yarn guiding eye 11 for supporting and guiding the unwound yarn length 12 during the winding of the unwound yarn length 12 onto the upper end 13 of the bobbin 1 to form an end winding 14 thereon. The yarn support member is disposed relative to the bobbin 1 so that the guiding eye 11 is opposite the approximate level of the upper end 13 of the bobbin 1 for support of the unwound yarn length 12 at a location at substantially the level of the upper en 13 of the bobbin 1. The yarn guiding eye 11 is formed by a bracket 17 mounted to the suction device 5 and having a sloped surface portion. A flange 19 is mounted on the bracket 17 by a spacing member 18 and has a sloped surface portion. The sloped surfaces of the bracket 17 and the flange 19 slope in opposite directions. The top of the yarn guiding eye 11 is defined by the lower surfaces of the sloped surface portions of the bracket 17 and the flange 19 and the bottom of the yarn guiding eye 11 is defined by the bracket 17. The sloped surfaces of bracket 17 and the flange 19 partially overlap transversely of the unwound yarn and are spaced from one another lengthwise of the unwound yarn length to define therebetween an opening of a yarn receiving slot 20 through which the unwound yarn length 12 passes into the yarn guiding eye 11. Additionally, the sloping surface portions of the bracket 17 and the flange 19 decline toward one another to slidingly guide the unwound yarn extent 12 downwardly into the yarn receiving slot 20 and into the yarn guiding eye 11. The bracket 17 is mounted to the suction device 5 such that the receiving slot 20 is transversely positioned relative to the yarn length 10 during unwinding thereof.

In operation, the suction producing means is activated to apply a suction force, via the hose 6, suction device 5 and its suction slot 7, to the yarn wound on the bobbin 1. The trailing end of the yarn is picked up by the suction and drawn through the suction slot 7. During the application of the suction force to the yarn on the bobbin 1, the bobbin is rotated in the unwinding direction by the rotating pulley 2 through the activation of the motor 4 to rotate the rotating pulley 2. The trailing yarn end is eventually drawn into the hose 6 by the suction action as the length of yarn unwound from the bobbin 1 continuously increases through the rotation of the bobbin 1 simultaneous with the application of the suction force to the trailing yarn end. When the unwound yarn length 10 has been drawn into the hose 6 such that it traverses the monitoring range of the yarn monitor 8, the yarn monitor 8 activates the blocking device to block the suction force and activates the cutting device 9 to release the unwound yarn end, which falls onto the sloping surface portions of the bracket 17 and the flange 19 and these sloping surface portions guide the unwound yarn length 10 downwardly through the receiving slot 20 into the yarn guiding eye 11. Due to the cooperative overlapping arrangement of the surface of the bracket 17 and the flange 19, the unwound yarn length 12 is prevented from moving upwardly out of the guiding eye 11 during winding thereof onto the upper end 13.

With the unwound yarn length 12 supported in the yarn guiding eye 11, the bobbin 1 is rotated in the unwinding direction and the hook-type fiber pieces of that portion of the yarn which is still wound on the bobbin 1 engage the unwound yarn length 12 and, together with the frictional engagement between this immediately trailing yarn and the unwound yarn length 13, causes the unwound yarn length 12 to wind around the upper end 13 to form the end winding 14.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A method for forming an end winding on an upper end portion of a bobbin on which yarn has been wound, comprising:

rotating the bobbin in an unwinding direction;

applying a releasable yarn pulling force to the trailing end of the yarn on the bobbin to effect unwinding of a length of yarn during said rotation of the bobbin in the unwinding direction, whereby said length of yarn continuously increases as the bobbin rotates;

releasing said length of yarn from said yarn pulling force;

supporting said released unwound length of yarn at a location at substantially the level of the upper end of the bobbin; and further rotating the bobbin in the unwinding direction to wind said released and supported unwound yarn length onto the upper end of the bobbin.

2. A method for forming an end winding according to claim 1 and characterized further in that said supporting of said unwound yarn length is performed by a supporting member and said releasing includes allowing said unwound yarn length to fall onto said supporting member.

3. A method for forming an end winding according to claim 2 and characterized further in that said supporting member includes a yarn guiding eye formed with a receiving slot and in that said releasing allows said unwound length of yarn to fall through said slot into said guiding eye, said yarn guiding eye supporting said received unwound yarn length at said location during winding of said unwound yarn length onto the upper end of the bobbin.

4. A method for forming an end winding according to claim 1, 2 or 3 and characterized further in that said releasable yarn pulling force is a suction force.

5. A method according to claim 1, 2 or 3 and characterized further in that winding of said unwound yarn length during said further rotating of the bobbin in the unwinding direction is accomplished by the frictional action between said unwound yarn length and the yarn still wound on the bobbin through the engagement of said unwound yarn length by hooked yarn fibers of said still wound yarn length.

6. An apparatus for forming an end winding on an upper end portion of a bobbin on which yarn has been wound, comprising:

means for rotating the bobbin in an unwinding direction;

means for applying a releasable yarn pulling force to the trailing end of the yarn on the bobbin to effect unwinding of a length of yarn during rotation of the bobbin in the unwinding direction by said rotating means, whereby said yarn length continuously increases as the bobbin rotates;

means for releasing said length of yarn from said yarn pulling force; and means for supporting said released unwound yarn length at a location at substantially the level of the upper end of the bobbin;

said rotating means being operable to further rotate the bobbin in the unwinding direction to wind said released and supported unwound yarn length onto the upper end of the bobbin.

7. An apparatus for forming an end winding on an upper end portion of a bobbin on which yarn has been wound according to claim 6 and characterized further in that said means for applying a releasable yarn pulling force and said releasing means are cooperatively arranged with respect to said supporting means such that said unwound yarn length falls onto said supporting means after being released from said means for applying a releasable yarn pulling force.

8. An apparatus for forming an end winding on an upper end portion of a bobbin on which yarn has been wound according to claim 6 and characterized further in that said supporting means include a yarn guiding eye formed with a receiving slot and in that said releasing means releases said unwound length of yarn to allow said yarn to fall through said receiving slot into said yarn guiding eye, said yarn guiding eye supporting said unwound yarn length at said location during winding of said unwound yarn length onto the upper end of the bobbin.

9. An apparatus for forming an end winding on an upper end portion of a bobbin on which yarn has been wound according to claim 6, 7 or 8 and characterized further in that said means for applying a releasable yarn pulling force is means for applying a suction force to the trailing end of the yarn.

10. In a textile machine of the type having a bobbin rotating device for rotating a bobbin with yarn wound thereon, a suction device for engaging a trailing end of the yarn wound on the bobbin and applying a releasable yarn pulling force thereto to effect unwinding of a yarn length during rotation of the bobbin in an unwinding direction and a device for releasing the unwound yarn length from the releasable yarn pulling force when an extent thereof has been unwound from the bobbin, the unwound yarn length providing a suitable length of yarn for winding onto the upper end of the bobbin as an end winding, a yarn support member positionable between the releasing device and the bobbin at a position relative to the unreleased unwound yarn length such that the unwound yarn length falls onto the yarn support member after it is released by the releasing device, said yarn support member being disposed relative to the bobbin for supporting the unwound yarn length at a location at substantially the level of the upper end of the bobbin during further rotation of the bobbin in the unwinding direction, whereby the unwound yarn length is wound on the upper end of the bobbin while being supported by the yarn support member during the rotation of the bobbin in the unwinding direction.

11. In a textile machine, a yarn support apparatus according to claim 10 and characterized further in that the releasing device is activated in response to a yarn monitor which senses the unwound yarn length in position for release.

12. In a textile machine, a yarn support apparatus according to claim 11 and characterized further in that said yarn support member includes a yarn guiding eye and a receiving slot communicating with said yarn guiding eye for receiving the released unwound yarn length as it falls, said slot having a first downwardly sloping surface transverse to the yarn length for guiding the released unwound yarn length through the receiving slot and into the yarn guiding eye.

13. In a textile machine, a yarn support apparatus according to claim 12 and characterized further in that said slot of said yarn support member includes a second downwardly sloping surface transverse to the yarn length, the first and second downwardly sloping surfaces being cooperatively arranged with respect to one another to define the receiving slot therebetween and the surfaces declining toward one another whereby the unwound yarn length is cooperatively guided by the sloping surfaces downwardly into the receiving slot.

14. In a textile machine, a yarn support apparatus according to claim 13 and characterized further in that the surfaces partially overlap one another transversely of the unwound yarn length and are spaced from one another lengthwise of the unwound yarn length to form an opening of the receiving slot into the yarn guiding eye.

* * * * *